US011952780B2

(12) United States Patent
Iftissen

(10) Patent No.: US 11,952,780 B2
(45) Date of Patent: Apr. 9, 2024

(54) DRAINAGE DEVICE FOR A CONSTRUCTION, IN PARTICULAR A ROOF OF A BUILDING OR A TERRACE

(71) Applicant: RIKKSEN, Chalon-sur-Saone (FR)

(72) Inventor: Gérard Iftissen, Saint-Martin d'Uriage (FR)

(73) Assignee: Rikksen, Chalon sur Saone (FR)

( * ) Notice: Subject to any disclaimer, the term of this patent is extended or adjusted under 35 U.S.C. 154(b) by 180 days.

(21) Appl. No.: 17/286,350

(22) PCT Filed: Oct. 14, 2019

(86) PCT No.: PCT/EP2019/077701
§ 371 (c)(1),
(2) Date: Apr. 16, 2021

(87) PCT Pub. No.: WO2020/078868
PCT Pub. Date: Apr. 23, 2020

(65) Prior Publication Data

US 2021/0348390 A1 Nov. 11, 2021

(30) Foreign Application Priority Data

Oct. 19, 2018 (FR) ..... 1859678

(51) Int. Cl.
*E04D 13/04* (2006.01)

(52) U.S. Cl.
CPC .. *E04D 13/0409* (2013.01); *E04D 2013/0422* (2013.01); *E04D 2013/0436* (2013.01)

(58) Field of Classification Search
CPC .... E04D 2013/0413; E04D 2013/0422; E04D 2013/0436; E04D 2013/0427; E04D 13/04;
(Continued)

(56) References Cited

U.S. PATENT DOCUMENTS 1,538,924 A * 5/1925 Boosey ..... E04D 13/0409 210/489
2,284,416 A * 5/1942 Gordon ..... E04D 13/0409 210/166
(Continued)

FOREIGN PATENT DOCUMENTS

EP 1 528 155 A2 5/2005
JP H0640159 U 5/1994
(Continued)

OTHER PUBLICATIONS

France Search Report and Written Opinion dated Jun. 21, 2019, issued in Application No. FR1859678, filed Oct. 19, 2018, 10 pages.
(Continued)

*Primary Examiner* — Jessica L Laux
(74) *Attorney, Agent, or Firm* — Christensen O'Connor Johnson Kindness PLLC

(57) ABSTRACT

A drainage device for a construction, e.g., a roof of a building or a terrace, for discharging rainwater, is provided. The drainage device includes a drainage head supported on the construction around a flow channel and defining a recovery space communicating with the outside and with the flow channel; and a mounting element having a support or attachment element capable of being engaged inside the discharge channel and abutting against the peripheral wall of the discharge channel. The device further includes a biasing element which connects the drainage head and the support or attachment element and is capable of acting on the support or attachment element so as to keep the drainage head supported on the outer surface of the construction.

9 Claims, 15 Drawing Sheets

(58) Field of Classification Search
CPC ..... E04D 13/0404; E04D 13/0409; E04D 13/0445
See application file for complete search history.

(56) References Cited

U.S. PATENT DOCUMENTS

| | | | | |
|---|---|---|---|---|
| 3,095,219 | A | 6/1963 | Tutty | |
| 4,035,297 | A * | 7/1977 | Aldridge | E04D 13/0409 251/339 |
| 5,234,582 | A * | 8/1993 | Savoie | E04D 13/0409 52/12 |
| 6,165,357 | A * | 12/2000 | Cormier | E04D 13/0409 52/12 |
| 6,168,208 | B1 * | 1/2001 | Thaler | E04D 13/0409 285/110 |

FOREIGN PATENT DOCUMENTS

| | | | |
|---|---|---|---|
| JP | 2000-352157 | A | 12/2000 |
| JP | 2001-193233 | A | 7/2001 |
| JP | 2006-045881 | A | 2/2006 |
| JP | 3749360 | B2 | 2/2006 |
| JP | 2015-001055 | A | 1/2015 |
| KR | 2010-0001891 | U | 2/2010 |
| WO | 92/00430 | A1 | 1/1992 |

OTHER PUBLICATIONS

International Search Report and Written Opinion dated Nov. 19, 2019, issued in corresponding International Application No. PCT/EP2019/077701, filed Oct. 14, 2019, 15 pages.

* cited by examiner

DRAINAGE DEVICE FOR A CONSTRUCTION, IN PARTICULAR A ROOF OF A BUILDING OR A TERRACE

TECHNICAL FIELD

The present invention relates to the field of drainage devices used for discharging rainwater accumulating on walls of constructions, in particular roofs of buildings and terraces.

BACKGROUND

Generally the flat slabs of roofs or terraces have holes for the flow of rainwater that is directed towards a discharge system through pipes.

In particular to avoid the discharge system being flooded and overflowing, equipping roofs and terraces with projecting drainage devices that surround the flow holes and that have passages so that the flow of discharge water is limited is known.

The patent DE 1 806 527 describes a drainage device that comprises a bottom ring supported on a roof around a discharge hole and a top ring that is mounted above the bottom ring and on which a perforated vertical cylinder is mounted, projecting with respect to the roof. The water passes through the perforations and, when the level of water reaches the top edge of the perforated vertical cylinder, the water overflows, so as to be directed towards the discharge hole. The drainage device comprises a perforated cover surrounding the perforated cylinder at a distance and mounted on the top ring. The drainage device is provided with a sealing membrane that has a passage, the edge of which is gripped between the bottom ring and the top ring and which extends over the roof, so that the drainage device is integrated in the sealing of the roof.

The aim of the present invention is to propose a water drainage device that is more adapted to requirements.

SUMMARY

According to one embodiment, a drainage device intended to be installed on a construction having an external surface and provided with a discharge channel, in particular on a roof of a building or a terrace, with in order to discharge in particular the rainwater, comprises:

a drainage head comprising an external wall and a recovery space and having a discharge passage around which the external wall has a support shoulder able to bear on the external surface of the construction, around the discharge channel, and at least one recovery passage; and a mounting element comprising a support or attachment element capable of being engaged inside the discharge channel and of abutting against the peripheral wall of the discharge channel, and a biasing element connecting the drainage head and the support or attachment element.

The support or attachment element comprises a plurality of elastically deformable arms having ends able to bear against the peripheral wall of the discharge channel, at points spaced apart in the circumferential direction, in a position deformed counter to their elasticity.

The biasing element is able to act on the support or attachment element, so that the ends of the arms of the support or attachment element, abutting against the peripheral wall of the discharge channel, under the effect of the biasing element, are able to hold said support shoulder of the drainage head in abutment on the external surface of the construction.

"Elastically deformable arm" means an arm capable of deforming non-permanently under the action of an external force, and of tending to resume its shape before deformation after the external force is stopped. The deformable character of the arms may be obtained through the material used, and/or through the sizing thereof having regard to the thickness thereof.

"Ends of the arms of the support or attachment element" means the free ends of the arms or the end parts of the arms that are provided with these free ends.

The biasing element may comprise at least one connection member connecting the drainage head and the support or attachment element and capable of acting, under the effect of a drive member able to move the connection member, on the support or attachment element.

In one embodiment, the support or attachment element may comprise a central portion provided with said arms at the periphery thereof, said biasing element cooperating with this central portion.

Advantageously, the biasing element cooperates by screwing with the central portion of the support or attachment element.

The ends of the arms of the support or attachment element abutting against the peripheral wall of the discharge channel are offset axially with respect to the central portion of the support or attachment element on the same side as the drainage head in the engaged position of said element inside the discharge channel.

The arms of the support or attachment element, in the idle position, can define a larger periphery than the periphery of the discharge channel.

In one embodiment, the arms of the support or attachment element may have a fold able to be in contact with the drainage head, on either side of this fold, a portion able to be engaged inside the discharge channel and an actuation portion adjacent to the drainage head and connected to the latter by the biasing element.

The biasing element may comprise screws passing through the drainage head and in engagement with the actuation portions of the arms.

In one embodiment, the biasing element may comprise a separation member placed in the space between the arms of the support or attachment element, and a movable rod connecting this separation member and the drainage head, the rod cooperating by screwing with the separation member in order to move the separation member with respect to the drainage head when said rod is rotated so as to act by pushing, in sliding, on non-axial portions of the arms in the direction that applies these arms against the wall of the discharge channel.

The biasing element may further comprise a compression plate disposed inside the drainage head mounted on the rod and constrained to translate with said rod, the arms of the support or attachment element extending through the compression plate. Advantageously, the compression plate is able to come axially into abutment against the support shoulder of the drainage head axially on the opposite side to the external surface of the construction.

The arms of the support or attachment element may be articulated on the drainage head and having ends able to come into abutment against the wall of the discharge channel under the effect of the separation member.

The screws of the biasing element may be mounted so as to be able to slide freely on the drainage head in the radial direction.

The recovery passage of the drainage head may comprise a calibrated bottom recovery passage and a top passage for recovery by overflow that is larger than the calibrated bottom passage.

The device may comprise an annular seal able to be interposed axially between the drainage head and the construction. Advantageously, the annular seal is axially prestressed in the position of holding the support shoulder of the drainage head in abutment on the external surface of the construction through the action of the biasing element on the support or attachment element.

The device may further comprise a perforated cover that is mounted on the drainage head and that surrounds the drainage head at a distance.

The drainage head may comprise an end pipe connected to said peripheral external wall and able to be engaged inside the discharge channel, said support or attachment element extending beyond the end edge of this end pipe.

DESCRIPTION OF THE DRAWINGS

Drainage devices will now be described by way of example embodiments, illustrated by the accompanying drawing, wherein.

DETAILED DESCRIPTION

Figure 1:
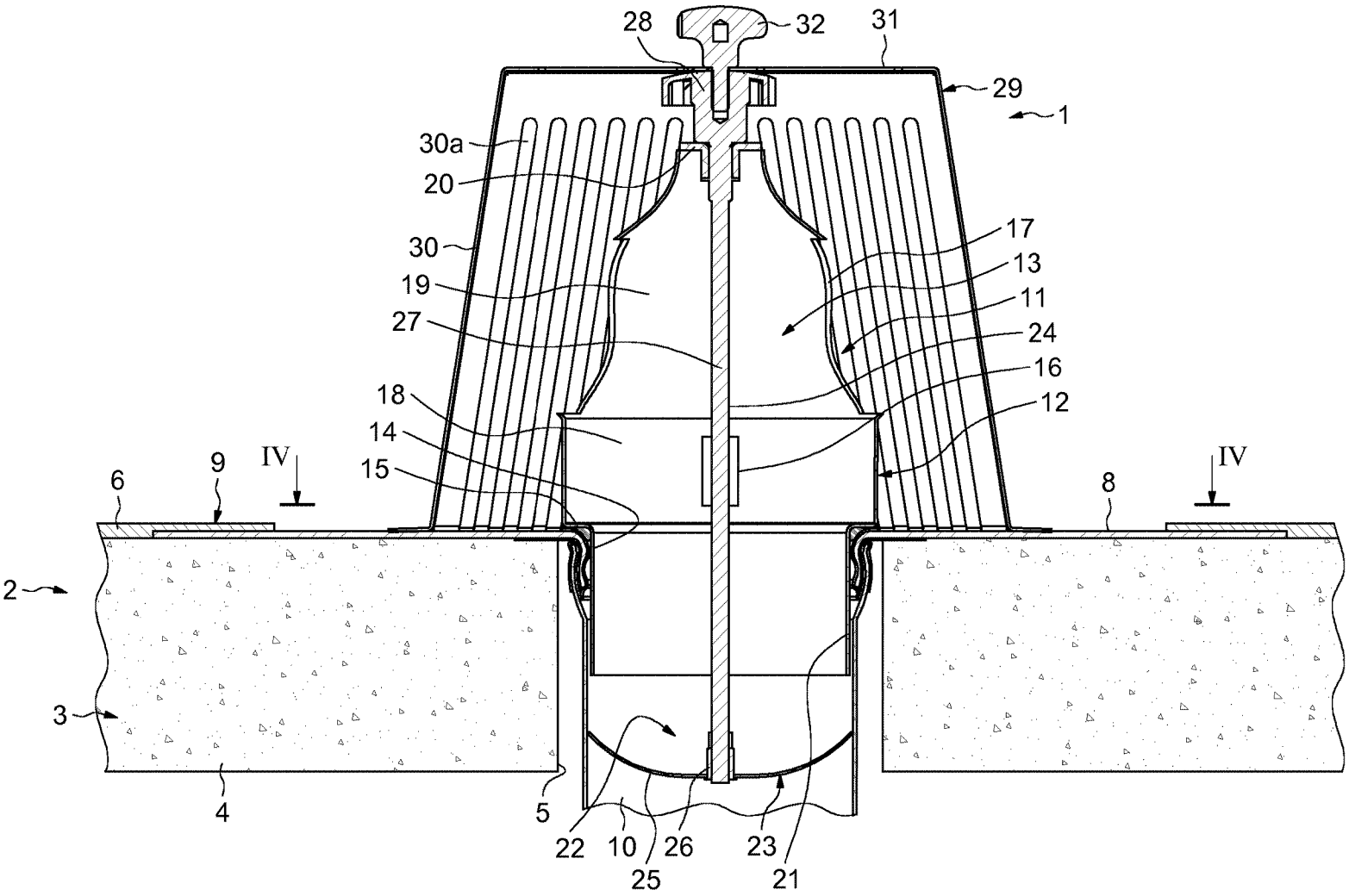
FIG. 1 shows a vertical section of a drainage device, including a drainage head provided with a mounting element and a cover, in the installed position.
Figure 2:
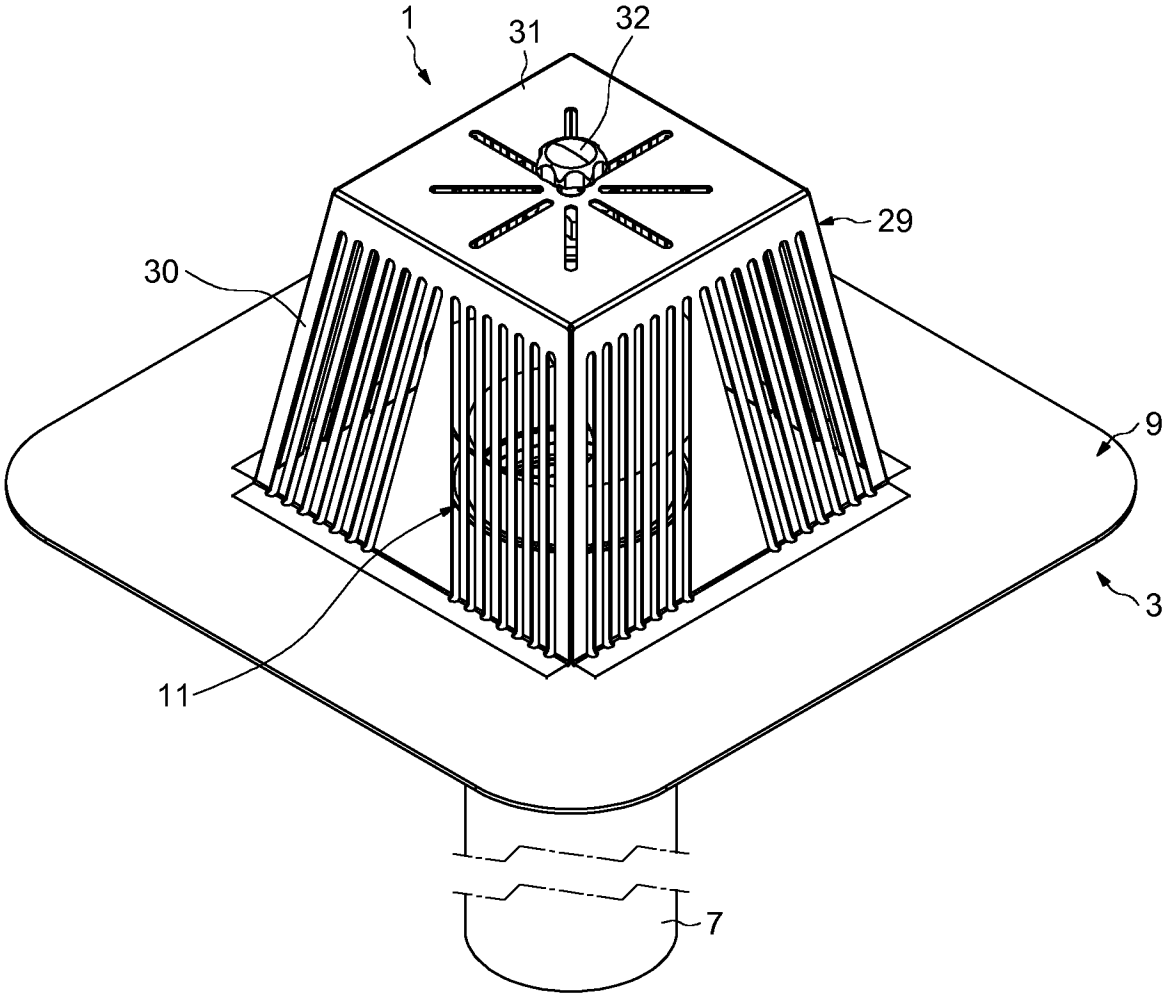
FIG. 2 shows a perspective view of the drainage device of FIG. 1.
Figure 3:
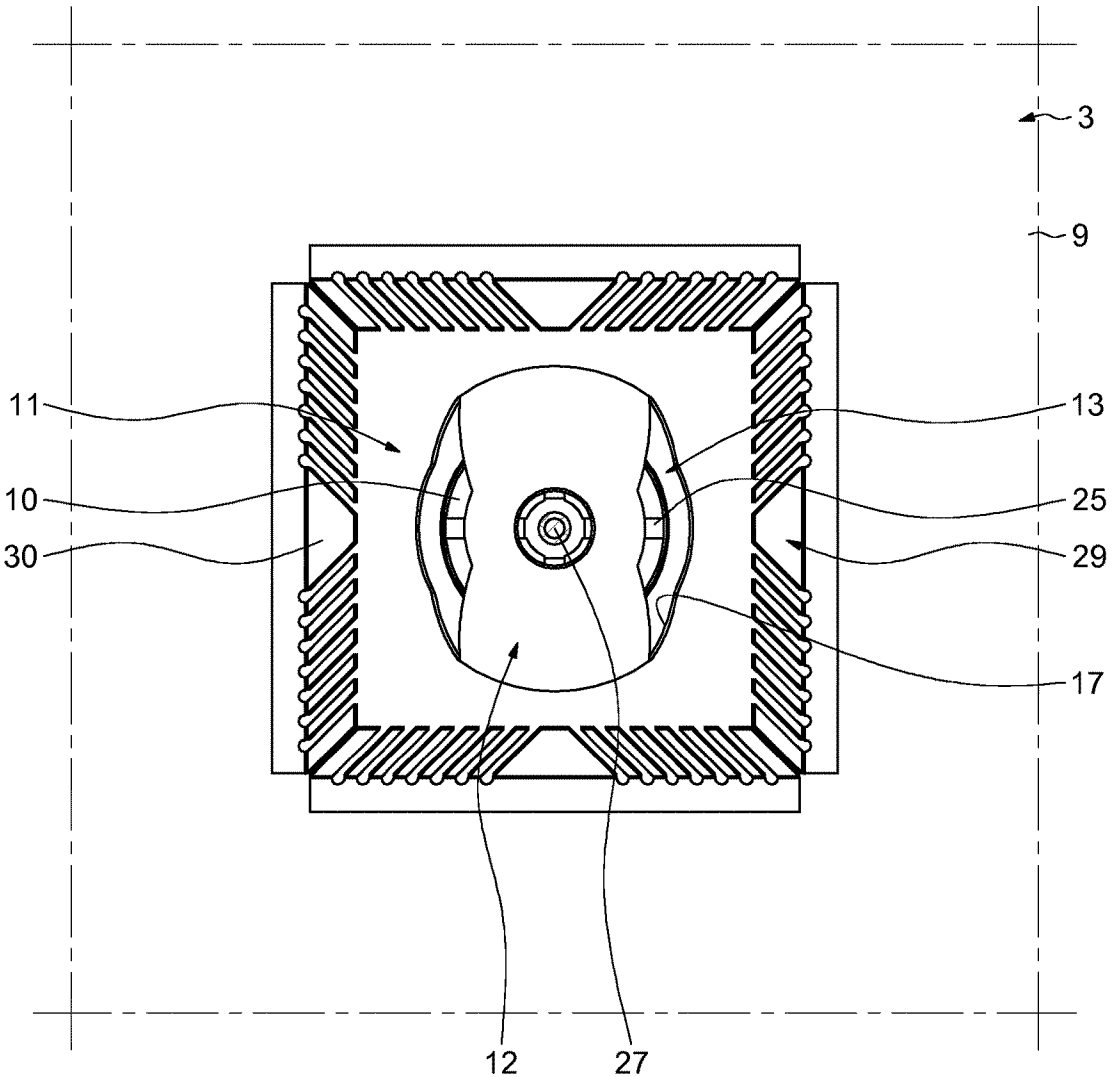
FIG. 3 shows a plan view of the drainage head, the top part of the cover being removed.
Figure 4:
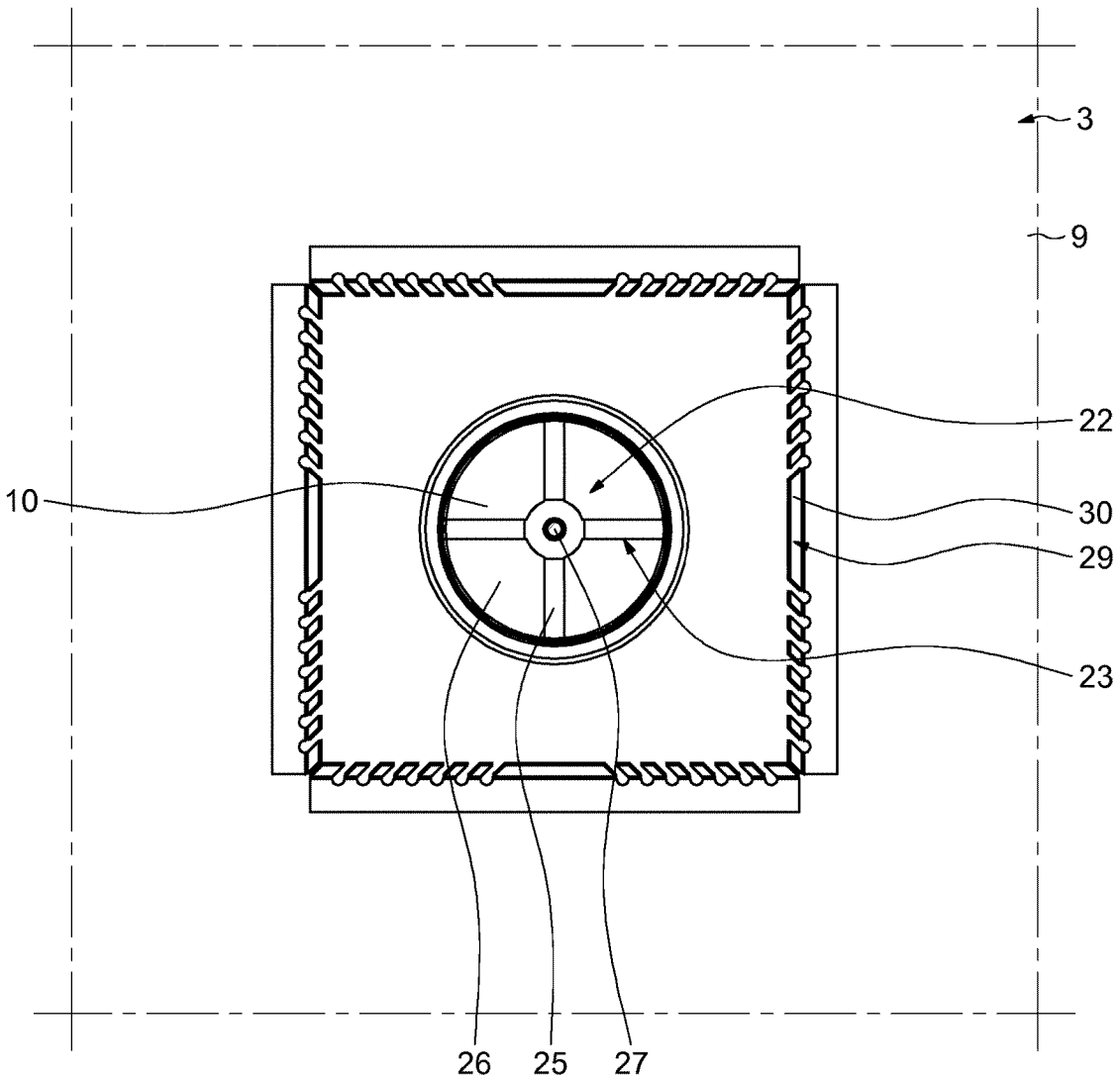
FIG. 4 shows a horizontal section, seen from the top downwards, of the drainage device of FIG. 1, through the bottom part of the drainage head and of the cover, along Iv-Iv in FIG. 1.

According to an example embodiment illustrated in FIGS. 1 to 6, a drainage device 1 is intended to be installed on a construction 2 that comprises a horizontal wall 3, for the purpose of discharging the water situated above this horizontal wall 3.

The horizontal wall 3 of the construction 2 comprises a slab 4 that has a vertical hole 5 and comprises a sealing covering 6 on top of the slab 4. A vertical discharge pipe 7 is disposed through the vertical hole 5. The top end of the discharge pipe 7 is connected to the sealing covering 6 by means of a membrane 8.

Thus the horizontal wall 3 of the construction 2 has a horizontal external surface 9 and is provided with a vertical discharge channel 10 delimited for example by the vertical pipe 7, for discharging the rainwater accumulating above the horizontal external surface 9.

The drainage device 1 comprises a drainage head 11 that comprises an external wall 12 that delimits an internal recovery space 13 intended to communicate with the outside and with the discharge channel 10. The external wall 12 is made for example from a metal sheet.

More specifically, the external wall 12 has a bottom discharge passage 14 around which a support shoulder 15 is provided, intended to bear on top of the external surface 9 of the horizontal wall 3 of the construction 2, around the discharge channel 8. The external wall 12 of the drainage head 11 extends upwards from the horizontal wall 3 and the internal recovery space 13 is above the mouth of the discharge channel 10.

The external wall 12 of the drainage head 11 has at least one water-recovery passage, intended to allow the water to enter, which is situated on the surface 9 of the horizontal wall 3 of the construction 2 around the external wall 12, in the recovery space 13, so that the water is discharged through the discharge channel 10 from the recovery space 13.

Advantageously, the external wall 12 has a calibrated bottom recovery passage 16 (FIGS. 1 and 7) and a top passage for recovery by overflow 17, which can both be formed by cutouts in the external wall 12. The bottom recovery passage 16 and the top recovery passage 17 are offset vertically. Nevertheless, the bottom recovery passage 16 and the top recovery passage 17 could communicate.

According to the example illustrated on the drawing, the external wall 10 is in the form of a bell and, on a vertical axis, comprises a cylindrical bottom portion 18 the bottom edge of which is provided, inside, with a support shoulder 15, which is annular, and a top portion 19 that bulges and then narrows, the narrowed end being provided with a top junction portion 20.

The calibrated bottom recovery passage 16 is provided through the bottom portion 18, from the support shoulder 15, and is formed for example by two opposite openings, and the top passage for recovery by overflow 17 is provided through the top portion 19 and is formed for example by two large opposite openings.

Optionally, the drainage head 11 comprises a bottom end pipe 21 that extends from the bottom edge of the support shoulder 15 and is intended to be engaged in the discharge channel 10.

When the drainage head 11 is installed on the horizontal wall 3, the end pipe 21 is engaged in the discharge channel 10 and the support shoulder 15 is in abutment above the horizontal wall 3 of the construction 2, around the discharge channel 10.

The rainwater located on the horizontal wall 3 of the construction 2, around the external wall 12 of the drainage head 11, can then be discharged in the following manner.

The rainwater flows through the calibrated bottom recovery passage 16 to the recovery space 13 delimited by the drainage head 11 and then flows from the recovery space 13 through the bottom discharge passage 14 and the end pipe 21 to the vertical discharge channel 8.

When the flow of water through the calibrated bottom recovery passage 16 is insufficient, the level of the water rises and then reaches the top recovery passage 15, which provides the overflow of the water into the recovery space 11 and then discharge through the discharge channel 10, at a greater rate than what is possible through the calibrated recovery passage 16.

The drainage device 1 comprises a mounting element 22 intended for holding the drainage head 11 in the installed position.

The mounting element 22 comprises a support or attachment element 23 able to be engaged inside the discharge channel 10 formed by the vertical pipe 7 and a biasing element 24 that connects the drainage head 11 and the support or attachment element 23 and is able to act on the support or attachment element 23. The support or attachment element 23 and the biasing element 24 are adapted for allowing the water to pass as described previously.

In the installed position, the support or attachment element 23 cooperates with the peripheral wall of the discharge channel 10, i.e. with the internal face of the vertical pipe 7, and firmly holds the support shoulder 15 of the drainage head 11 in abutment on top of the horizontal wall 3.

According to the example shown, the support or attachment element 23 comprises a plurality of support members 25 made from an electrically deformable material, able to cooperate, counter to their elasticity, with the peripheral wall of the discharge channel 10, at circumferentially spaced points, under the effect of the biasing element 24.

More particularly, the support members 25 are formed by a plurality of arms or fins, for example metal, which extend from a central portion 26 of the support or attachment element. The central portion 26 has a cylindrical shape. For example, four arms disposed at 90° from each other are provided. Alternatively, it is possible to provide a lesser or greater number of arms.

The biasing element 24 comprises a vertical rod 27, which extends axially to the discharge channel 10 and therefore to the discharge passage 14 and to the pipe 21. The bottom end of the rod 27 is coupled to the central portion 26 and the top end thereof passes through the top connecting portion 20 of the drainage head 11 and is provided with an external maneuvering member 28 in abutment on top of the junction portion 20 of the drainage head 11.

The bottom end of the rod 27 of the biasing element is coupled by screwing to the central portion 26 of the support or attachment element. For this purpose, the external surface of this bottom end is equipped with an external thread (not shown) in engagement with an internal thread (not shown) on the central portion 26 of the support or attachment element.

Figure 5:
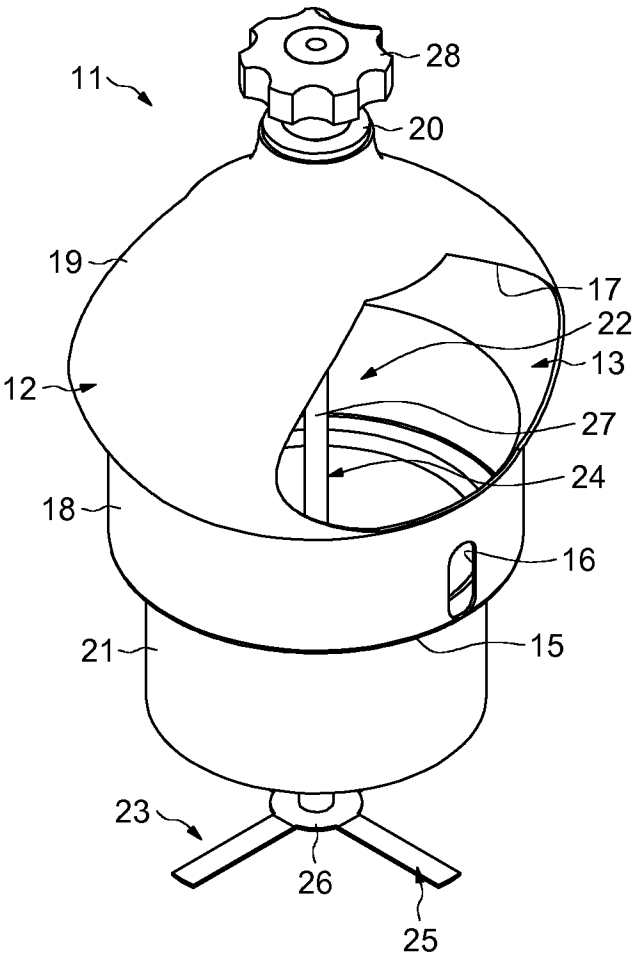
FIG. 5 shows a view, in perspective only, of the drainage head and of the element for mounting the drainage device of FIG. 1, in the non-installed position.
Figure 6:
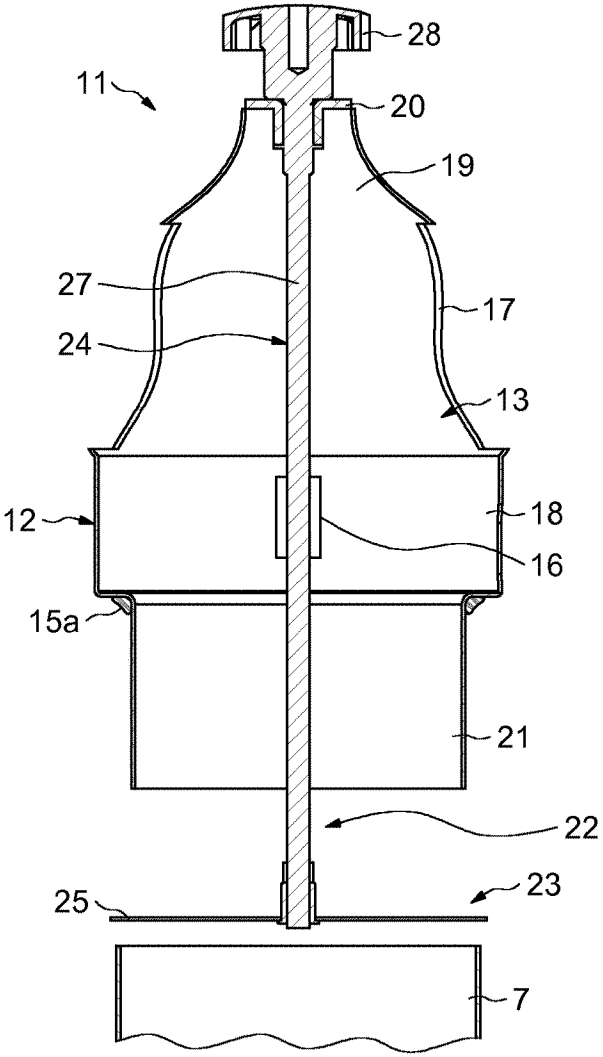
FIG. 6 shows a vertical section only of the drainage head and of the element for mounting the drainage head of FIG. 1, in the non-installed position.

As illustrated in FIGS. 5 and 6, when the mounting element 22 is in the idle position, that is to say is not installed, the ends of the arms 25 define a larger periphery than the periphery of the discharge channel 10, i.e. larger than the inside diameter of the discharge pipe 7.

The drainage installation 11 can be installed in the following manner.

When the drainage head 11 is fitted on the construction 2, the end pipe 21 being introduced into the discharge channel 10 and the shoulder 15 being brought onto the external surface 9 of the horizontal wall 3, the support or attachment element 23 is introduced from the top downwards into the discharge channel 10 under the effect of the biasing element 24 formed by the rod 27.

At the time of this introduction, the elastic arms 25 curve and the ends thereof, located higher than the central portion 26, bear and slide against the internal face of the discharge channel 10, the maneuvering member 28 being in abutment on top of the top portion 20 of the drainage head.

In the final position, the drainage head 11 is kept installed by means of the effect of support and attachment of the ends of the elastic arms 25 against the wall of the discharge channel 10, in the opposite direction to the introduction direction. The ends of the arms 25 in abutment against the wall of the discharge channel 10 are offset axially with respect to the central portion 26 of the support or attachment element on the drainage head 11 side.

As indicated previously, the bottom end of the rod 27 is screwed into the central portion 26 of the support or attachment element 23. To increase the bearing force of the drainage head 11 on top of the external surface 9 of the construction 2, the rod 27 is turned by means of the maneuvering member 28, so as to pull the central portion 26 of the support or attachment element 23 upwards, so as to move together the central portion 26 and the junction portion 20, and to increase the curvature, and therefore the deformation, of the elastic arms 25.

This ensures good axial pressing of the drainage head 11 against the external surface 9 of the construction 2 under the effect of this rotation of the rod 27 that acts on the arms 25. The rotation of the rod 27 ensures that the drainage head 11 is put under axial pressure.

Optionally, as illustrated in FIG. 6, the drainage device 1 advantageously comprises an external annular seal **15*a* on the same side as the support shoulder 15 of the drainage head 11, intended to come into abutment on the edge of the wall 3 of the construction 2 surrounding the discharge channel 10. Specifically, the external annular seal 15*a* surrounds the end pipe 21. The external annular seal 15*a* is interposed axially between the drainage head 11 and the edge of the wall 3 of the construction 2. Thus, during the pressurization that is implemented when the rod 27 is rotated in the final position of the drainage head 11, an axial compression of the external annular seal 15*a* between this head 11 and the edge of the wall 3 of the construction 2** is obtained.

The drainage device 1 further comprises a perforated cover 29, in the form of a bell, that surrounds the drainage head 1 at a distance and is mounted thereon. The perforated cover 29 comprises a peripheral wall 30 provided with a plurality of perforations **30*a*, the bottom edge of which is adjacent to the top face 9 of the horizontal wall 3 of the construction 2 and comprises a perforated bottom 31 that passes above the maneuvering member 28. The perforated cover 29 is held by means of a screw 32 that passes through the bottom 31 and is screwed into the maneuvering member 28**.

The result of the above is that the drainage head 11 and the cover 29 are held without any intervention on the wall 3 of the construction 2 and without any intervention in the discharge channel 10 delimited by the pipe 7. The drainage device 1 can therefore be installed on a new or already existing construction.

Figure 7:
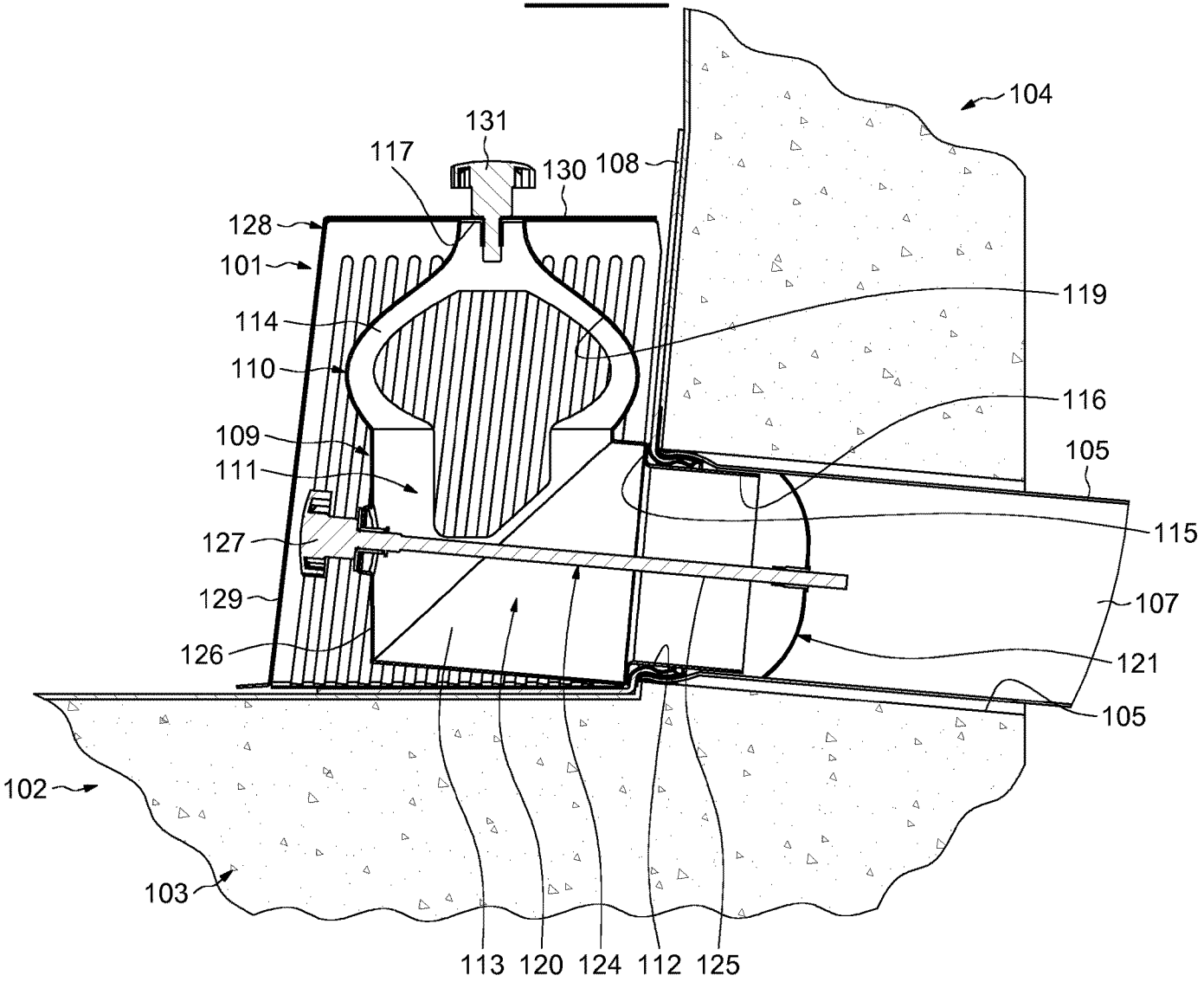
FIG. 7 shows a vertical section of another drainage device, including a drainage head provided with a mounting element and a cover, in the installed position.
Figure 8:
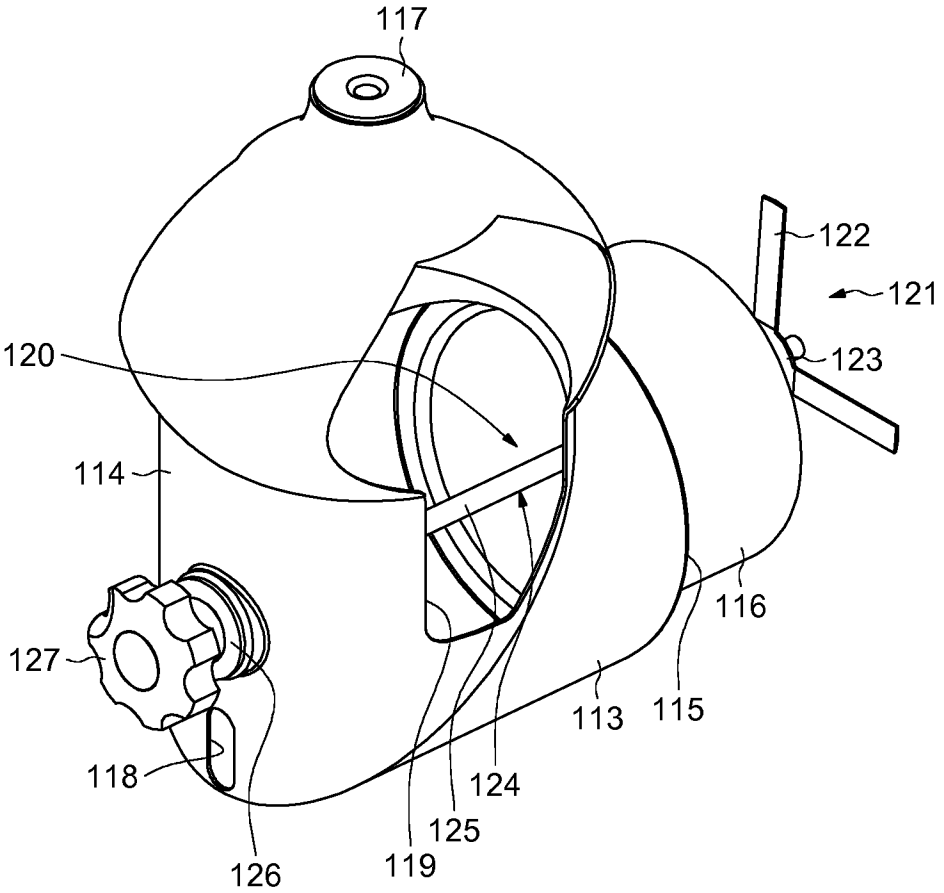
FIG. 8 shows a view in perspective only of the drainage head and of the element for mounting the drainage device of FIG. 7, in the non-installed position.

According to another example embodiment illustrated in FIGS. 7 and 8, a drainage device 101 is intended to be installed on a construction 102 that comprises a horizontal wall 103 bordered by a vertical wall 104. The drainage device 101 is intended to be installed on the vertical wall 104 so as to discharge the water located on the horizontal wall 103.

Similarly to the previous example, the vertical wall 104 of the construction 102 has a hole 105 equipped with a discharge pipe 106 connected to the seal of the horizontal and vertical walls 103 and 104, so as to delimit a discharge channel 107.

The discharge pipe 106 emerges in proximity to the horizontal wall 104 and extends for example so as to be slightly inclined downwards from its mouth, perpendicularly to a slightly inclined external bottom surface 108 of the vertical wall 104 that surrounds this mouth.

The drainage device 101 comprises a drainage head 109 that comprises an external wall 110, in the form of a coffer, that delimits an internal recovery space 111 and communicates with the outside through at least one recovery passage, intended to allow the water to enter towards the recovery space 111, and with the discharge channel 107 through a discharge passage 112. The discharge passage 112 is formed laterally to the external wall 110 of the drainage head 109.

More specifically, the external wall 110 of the drainage head 109 is in the form of an elbow and has a bottom branch 113, almost horizontal, and a vertical branch 114 that extends upwards. The external wall 110 can be manufactured from two portions of tubes cut aslant at 45°, the edges cut at 45° being connected to each other.

Similarly to the drainage head 11, the end of the bottom branch 113 of the external wall 110 is provided with an internal annular support shoulder 115 in abutment, this time laterally, on the external surface 108 of the vertical wall 104, around the discharge channel 107. The drainage head 109 comprises an end pipe 116 that extends from the internal edge of the support shoulder 115 and which is engaged in the discharge channel 107. The internal edge of the support shoulder 115 and the end pipe 116 determine a discharge passage 112.

The result of this mounting is that the bottom arm 113 of the external wall 110 is adjacent to the surface of the horizontal wall 103 of the construction 102.

The top arm 114 of the external wall 110 extends at a distance from the vertical wall 104 of the construction 102 and, similarly to the drainage device 1, is bulged and then narrowed, the narrowed end being provided with a top junction portion 117.

Advantageously, the external wall 110 has a calibrated bottom recovery passage 118 (FIG. 9) and a top passage 119 for recovery by overflow, which can be formed by cutouts in the external wall 110. The bottom recovery passage 118 and the top recovery passage 119 are offset vertically. Nevertheless, the bottom recovery passage 118 and the top recovery passage 119 could communicate.

The functioning of the drainage head 110, mounted on the vertical 104 on the construction 102, is similar to the functioning of the drainage head 11 mounted on the horizontal wall 3 of the construction 2.

The rainwater located on the horizontal wall 103 of the construction 102 and retained by the vertical wall 104, around the external wall 110 of the drainage head 109, can then be discharged as follows.

The rainwater flows through the calibrated bottom recovery passage 118 towards the recovery space 111 delimited by the drainage head 11, and then flows from the recovery space 111 through the lateral discharge passage 112 towards the inclined discharge channel 107.

When the flow of water through the calibrated bottom recovery passage 118 is insufficient, the level of the water rises and then reaches the top recovery passage 119, which provides the overflow of the water into the recovery space 111 and then the discharge through the discharge channel 107, at a greater rate than what is possible through the calibrated recovery passage 118.

The drainage device 101 comprises a mounting element 120 intended for holding the drainage head 109 in the installed position laterally to the vertical wall 104 of the construction 102.

The mounting element 120 comprises a support or attachment element 121 that cooperates with the peripheral wall of the discharge channel 107 and which comprises, as illustrated in FIG. 8, a plurality of support members 122 made from an elastically deformable material, formed by a plurality of arms or fins, for example metal, which extend from a central portion 123, which are flexed counter to their elasticity and the ends of which are in engagement with the peripheral wall of the discharge channel 107.

The mounting element 120 comprises, by way of biasing element 124 connecting the support or attachment element 121 and the drainage head 109, a rod 125, almost horizontal, which extends axially to the discharge channel 107 and therefore to the discharge passage 112 and to the end pipe 116. One end of the rod 124 is coupled to the central portion 123 and the other end thereof passes through the part of the external wall 110 of the drainage head 109, opposite to the discharge passage 112 and reinforced by a washer 126, and is provided with an external maneuvering member 127 in abutment on top of the washer 126 of the external wall 110.

The mounting element 120 is positioned and functions similarly to the mounting element 24 of the previous example, so as to keep the drainage head in abutment against the external surface 108 of the vertical wall 104 of the construction 102.

The drainage device 101 further comprises a perforated cover 128 installed at a distance from the drainage head 109.

The perforated cover 128 comprises a lateral wall 129, with a horizontal section in a C shape, the bottom edge of which is adjacent to the surface of the horizontal wall 103 of the construction 102, and a horizontal top wall 130 in abutment on the top junction portion 117 of the drainage head 109, to which it is fixed by means of a screw 131.

Figure 9:
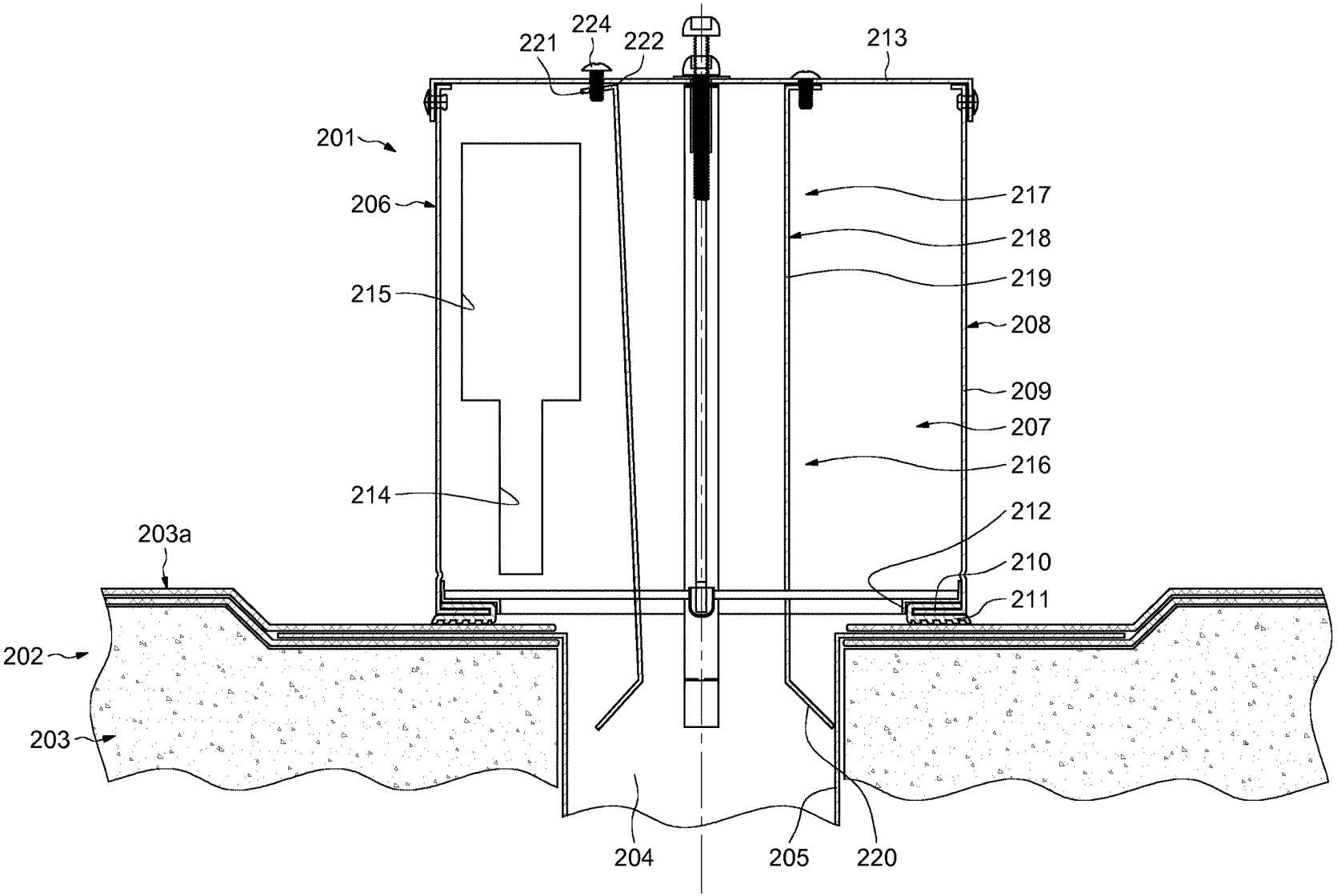
FIG. 9 shows a vertical section of another drainage device, including a drainage head provided with a mounting element, in the installed position.

According to another example embodiment illustrated in FIG. 9, a drainage device 201 is intended to be installed on a construction 202 that comprises a horizontal wall 203, for the purpose of discharging the water located above this horizontal wall 203.

Similarly to the construction 2 in FIG. 1, the horizontal wall 203 of the construction 202 has a vertical discharge channel 204 delimited by a vertical discharge pipe 205, the top end of which is connected to the seal of the surface of the horizontal wall 203.

The drainage device 201 comprises a drainage head 206 that delimits an internal recovery space 207 above the discharge channel 204.

The drainage head 206 comprises an external wall 208, in the form of a bell, which comprises a vertical cylindrical peripheral wall 209 the bottom edge of which is provided with an annular support shoulder 210 in abutment on the external surface **203*a* of the horizontal wall 203 of the construction 202, around the discharge channel 204, by means of an annular seal 211 and which delimits a discharge passage 212. The external wall 208 comprises a top radial wall 213**.

The peripheral wall 209 has at least one recovery passage. For example, the peripheral wall 209 has calibrated bottom recovery passages 214 and top overflow passages 215, which communicate with each other. The top radial wall 213 may also have recovery passages.

The flows of water via the drainage head 201 are similar to those via the drainage head 11 described previously.

The drainage device 201 comprises a mounting element 216 intended to keep the drainage head 206 in position installed above the horizontal wall 203 of the construction 202.

The mounting element 216 comprises support or attachment element 217 intended to cooperate with the peripheral wall of the discharge channel 204, that is to say with the internal surface of the discharge pipe 205.

The support or attachment element 217 comprises a plurality of spaced-apart support members 218, which are formed by arms, for example metal, and comprise elongate portions 219 that extend from the top radial wall 213 of the drainage head 206, which pass down through the recovery space 207 and enter the discharge channel 204. In the example embodiment illustrated, the arms 218 are two in number. In a variant, it is possible to provide a greater number of arms 218.

The bottom end parts 220 of the elongate portions 219 are inclined towards the peripheral wall of the discharge channel 204. The elongate portions 219 are situated at a distance from each other so that the bottom ends thereof can come into abutment against the peripheral wall of the discharge channel 204, at points spaced apart in the peripheral direction.

The arms 218 comprise top actuation portions 221 connected to the top ends of the elongate portions 219, forming pivoting folds 222 able to come into abutment against the bottom face of the top radial wall 213 of the drainage head 206. The top actuation portions 221 are adjacent to the top radial wall 213 of the drainage head 206 and extend radially in the direction of the peripheral wall 209 of the drainage head 206.

The mounting element 216 comprises, by way of biasing element connecting the support or attachment element 217 and the drainage head 206, a plurality of traction screws 224 that pass through the top radial wall 213 of the drainage head 206 and which are in engagement with the top actuation portions 221 of the arms forming the support members 218.

The drainage device 201 can be installed in the following manner.

The drainage head is placed in abutment on top of the external surface 203*a* of the construction 202.

At the same time, the traction screws 224 not being tightened, the elongate portions 219 of the branches forming the support members 218 are freely engaged in the discharge channel 204 of the construction 202.

Then, by actuating the traction screws 224, the top actuation portions 221 of the arms forming the support members 218 can be brought closer to the bottom face of the top radial wall 216 of the drainage head 206, which causes, substantially radially, the pivoting of the elongate portions 219 about the pivoting folds 222 in abutment against the top radial wall 216 and brings the bottom ends of the elongate portions 220 into abutment against the peripheral wall of the discharge channel 204, causing support and attachment forces, so as to hold the drainage head 206 in its installed portion in abutment on the surface 203*a* of the construction 202.

The arms forming the spaced-apart support members 218 may be rigid or made from an elastically deformable material, these arms being deformed against the peripheral wall of the discharge channel 204 and exerting bearing forces counter to their elasticity.

Similarly to the drainage device 1, the drainage device 201 may furthermore comprise a perforated cover (not shown) surrounding the drainage head 206 at a distance and mounted thereon.

According to another example embodiment (not shown), an element for mounting a drainage head comprises a support and attachment element comprising arms forming spaced-apart support members, articulated on the drainage head and engaged in a discharge channel of a construction, and a biasing element comprising a separation member placed in the space between these arms and a connection member connecting the separation member and the drainage head formed for example by an axial rod able to move in rotation or axially.

For example, under an axial effect of this rod, by virtue of a nut and screw element between the rod and the separation member and/or the drainage head, the separation member can be moved axially, in one direction or in the other, so as to act by traction or thrust, sliding, on non-axial portions of the arms forming support members, in the direction that applies the ends of these arms against the wall of the discharge channel in order to keep the drainage head in abutment on the surface of the construction around the discharge channel.

The arms forming support members, the separation member and the axial rod are arranged to allow the water to pass.

Figure 10:
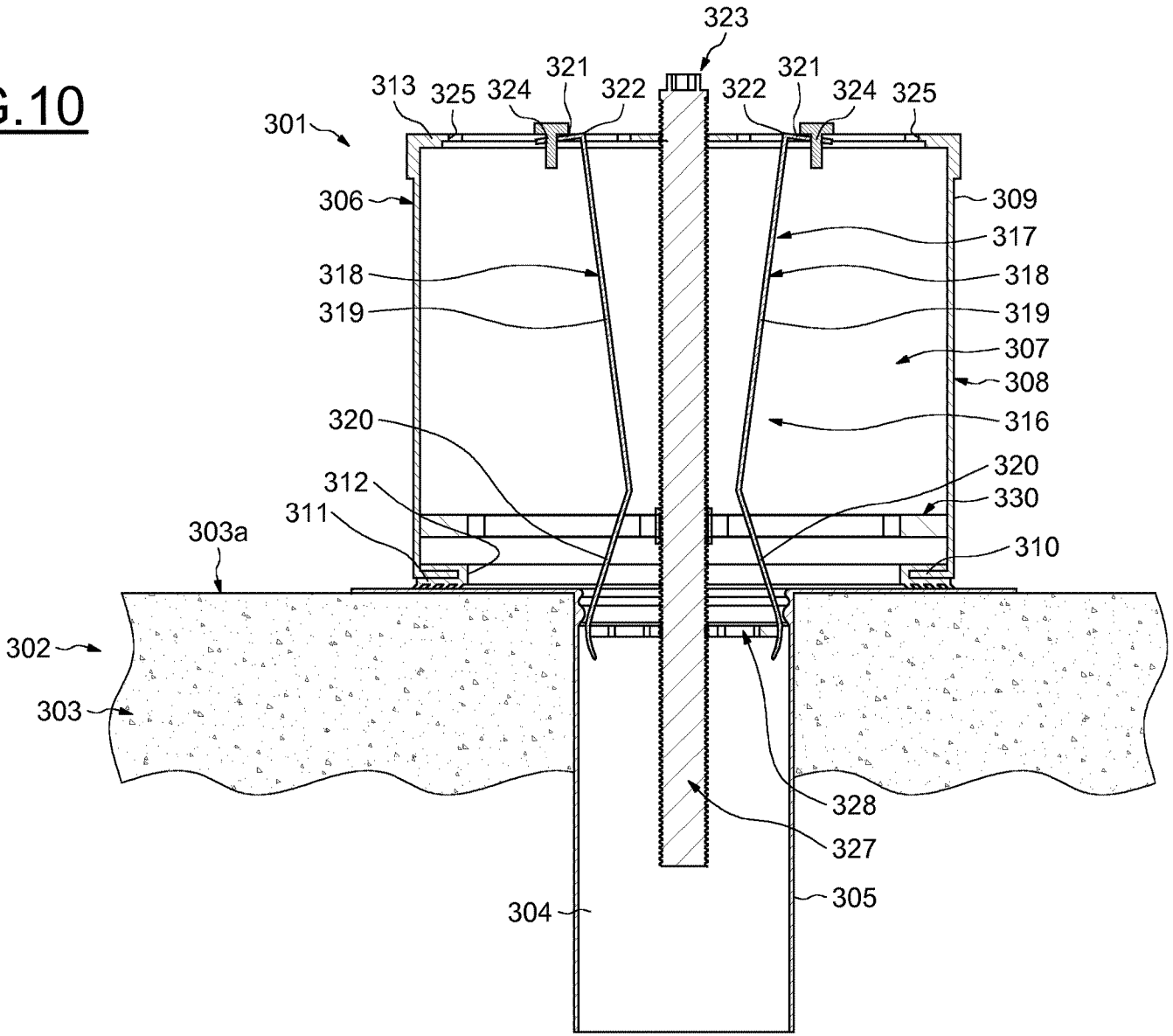
FIG. 10 shows a vertical section of another drainage device, including a drainage head provided with a mounting element, in the engaged and non-locked position.
Figure 11:
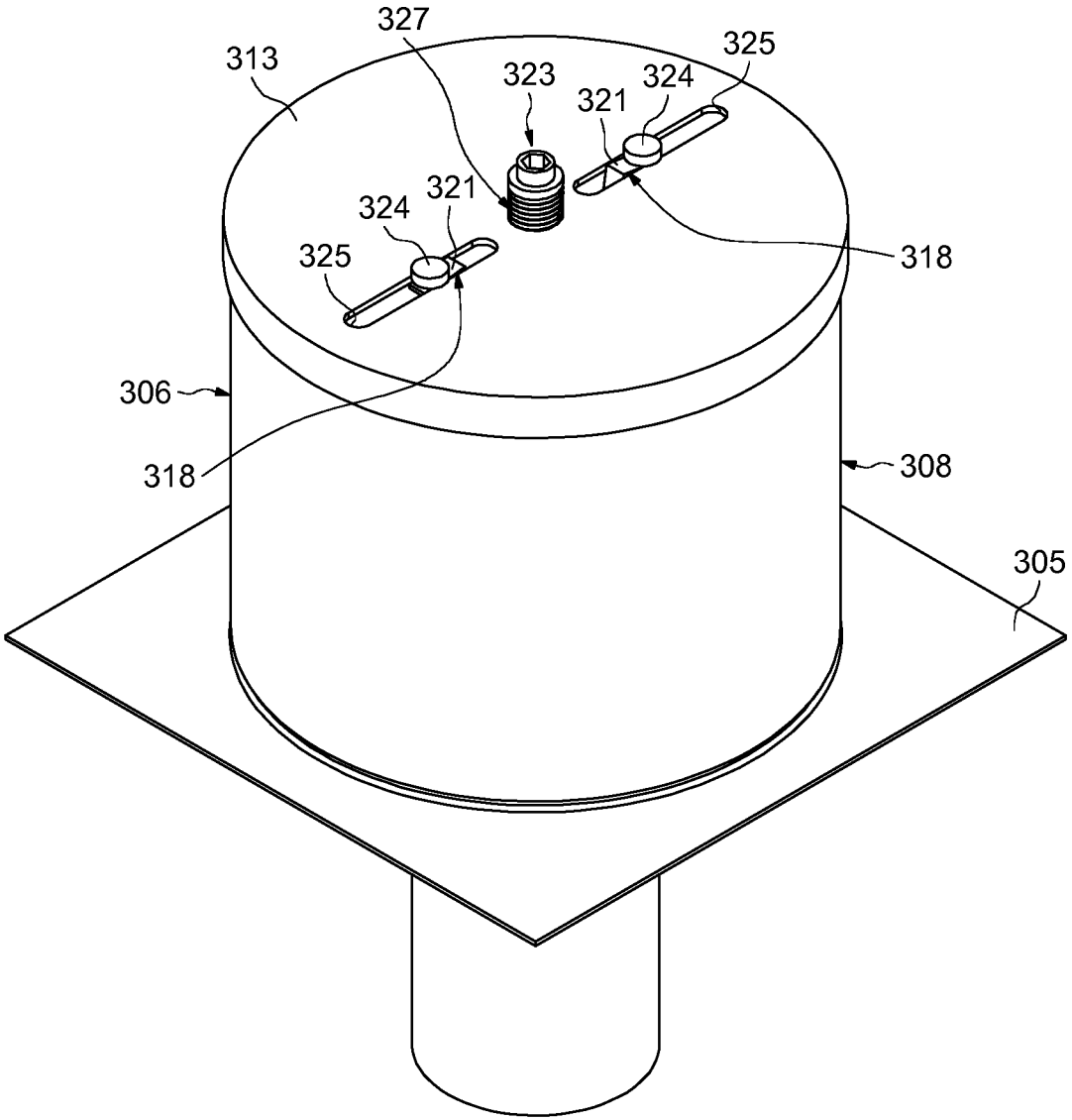
FIG. 11 shows a view in perspective of the drainage device of FIG. 10.

For example, according to the example embodiment illustrated in FIGS. 10 and 11 with a design similar to that of FIG. 9, a drainage device 301 is intended to be installed on a construction 302 that comprises a horizontal wall 303, for the purpose of discharging the water located above this horizontal wall 303.

Similarly to the construction in FIG. 9, the horizontal wall 303 of the construction 302 has a vertical discharge channel 304 delimited by a vertical discharge pipe 305, the top end of which is connected to the seal (not shown) of the surface of the horizontal wall 303.

The drainage device 301 comprises a drainage head 306 that delimits an internal recovery space 307 above the discharge channel 304.

The drainage head 306 comprises an external wall 308, in the form of a bell, that comprises a vertical cylindrical peripheral wall 309 the bottom edge of which is provided with an annular support shoulder 310 in abutment on the external surface 303*a* of the horizontal wall 303 of the construction 302, around the discharge channel 304, by means of an annular seal 311, and which delimits a discharge passage 312. The external wall 308 comprises a top radial wall 313.

The peripheral wall 309 has at least one recovery passage (not shown) as indicated in the previous example embodiments. In an identical manner to the previous example embodiment, for example, the peripheral wall 309 may have calibrated bottom recovery passages and top overflow passages, which communicate with each other. The top radial wall 313 may also have recovery passages.

The flows of water via the drainage head 301 are similar to those via the drainage head 11 described previously.

The drainage device 301 comprises a mounting element 316 intended for holding the drainage head 306 in position installed on top of the horizontal wall 303 of the construction 302.

The mounting element 316 comprises a support or attachment element 317 intended to cooperate with the peripheral wall of the discharge channel 304, i.e. with the internal surface of the discharge pipe 305.

The support or attachment element 317 comprises a plurality of spaced-apart support members 318, which are formed by blades or arms, for example metallic, and comprise elongate portions 319 that extend from the top radial wall 313 of the drainage head 206, which pass down through the recovery space 307 and enter the discharge channel 304. In the example embodiment illustrated, the arms 318 are two in number. In a variant, it is possible to provide a greater number of arms 318.

The bottom end parts 320 of the elongate portions 319 are inclined towards the peripheral wall of the discharge channel 304. The elongate portions 319 are located at a distance from each other so that the bottom ends thereof can come into abutment against the peripheral wall of the discharge channel 304, at points spaced apart in the peripheral direction. Unlike the example embodiment illustrated in FIG. 9, the bottom end parts 320 of the arms here each have a free end curved towards the inside of the discharge channel 304.

The arms 318 comprise top actuation portions 321 connected to the top ends of the elongate portions 319 while forming folds 322 able to come into abutment against the bottom face of the top radial wall 313 of the drainage head 306, as will be indicated hereinafter. The top actuation portions 321 are adjacent to the top radial wall 313 of the drainage head 306 and extend radially in the direction of the peripheral wall 309 of the drainage head 306.

The mounting element 316 comprises a biasing element 323 connecting the support or attachment element 317 and the drainage head 306. The biasing element 323 comprises a plurality of holding screws 324 that pass through the top radial wall 313 of the drainage head 306 and which are in engagement with the top actuation portions 321 of the arms 318. The heads of the screws 324 come axially into abutment against the top face of the top radial wall 313 of the drainage head 306.

Contrary to the example embodiment illustrated in FIG. 9, the screws 324 are mounted on the drainage head 306 with the possibility of free sliding in the radial direction. For this purpose, radial slots 325 are provided on the top radial wall 313 of the drainage head and allow screws 334 to pass. The slots 325 are diametrically opposed.

In this example embodiment, the biasing element 323 also comprises a vertical rod 327 that extends axially to the discharge channel 304. The rod 327 extends axially inside the drainage head 306 and inside the discharge pipe 305. The rod 327 extends through the top radial wall 313 of the drainage head. The rod 327 extends axially so as to project with respect to the drainage head 306. The external surface of the rod 327 is equipped with an external thread (not referenced). The top radial wall 313 of the drainage head comprises a female thread (not referenced) in engagement with the external thread of the rod 327.

The biasing element 323 also comprises a separation member 328 mounted on the rod 327 and disposed in the space between the arms 318. The separation member 328 is disposed in the space between the bottom end parts 320 of the arms that are located in the discharge pipe 305.

Figure 12:
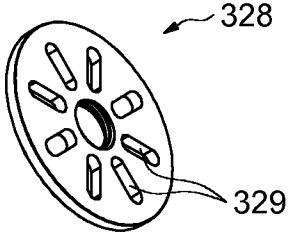
FIG. 12 is a perspective view of a separation member of the drainage device of FIG. 10.

The separation member 328 is in the form of a washer. The separation member 328 is equipped with a threaded bore (not referenced) in engagement with the external thread of the rod 327. As illustrated more visibly in FIG. 12, the separation member 328 is provided with a plurality of through oblong holes 329 for the rainwater to pass.

Referring once again to FIGS. 10 and 11, the biasing element 323 also comprises a compression plate 330 mounted on the rod 327. The plate 330 comprises a central bore for mounting thereof on the rod 327. The bore of the plate is smooth, i.e. with no thread in engagement with that of the rod 327.

Figure 13:
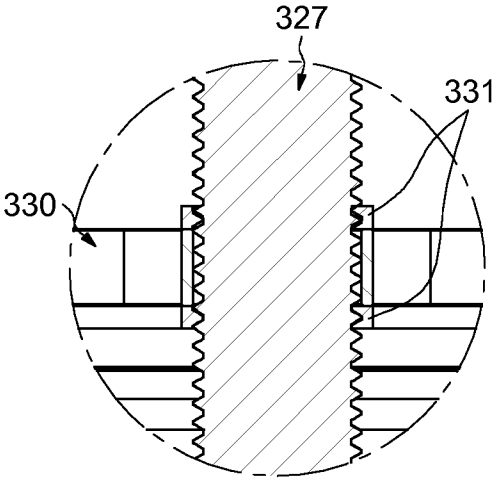
FIG. 13 is a detail view of FIG. 10.

The compression plate 330 is constrained to translate with the rod 327. In the example embodiment illustrated, two stops 331 (FIG. 13) are for this purpose attached to the external surface of the rod 327 axially on either side of the compression plate 330.

Figure 14:
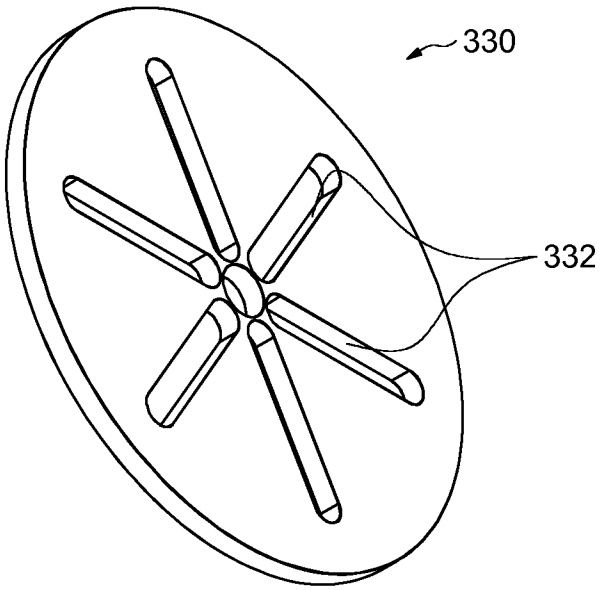
FIG. 14 is a perspective view of a compression plate of the drainage device of FIG. 10.

The compression plate 330 is mounted inside the drainage head 306. The plate 330 is mounted axially inside the drainage head in proximity to the shoulder 310 and to the seal 311. In the position illustrated in FIG. 10, the compression plate 330 is axially at a distance from the shoulder 310 and from the seal 311. As illustrated more visibly in FIG. 14, the compression plate 330 is provided with a plurality of through oblong holes 332 for the rainwater to pass. The arms 318 extend through the oblong holes 332 of the compression plate 330.

The drainage device 301 can be installed in the following manner.

The drainage head 301 is placed in abutment on top of the external surface 303*a* of the construction 302, as shown in FIG. 10.

Figure 15:
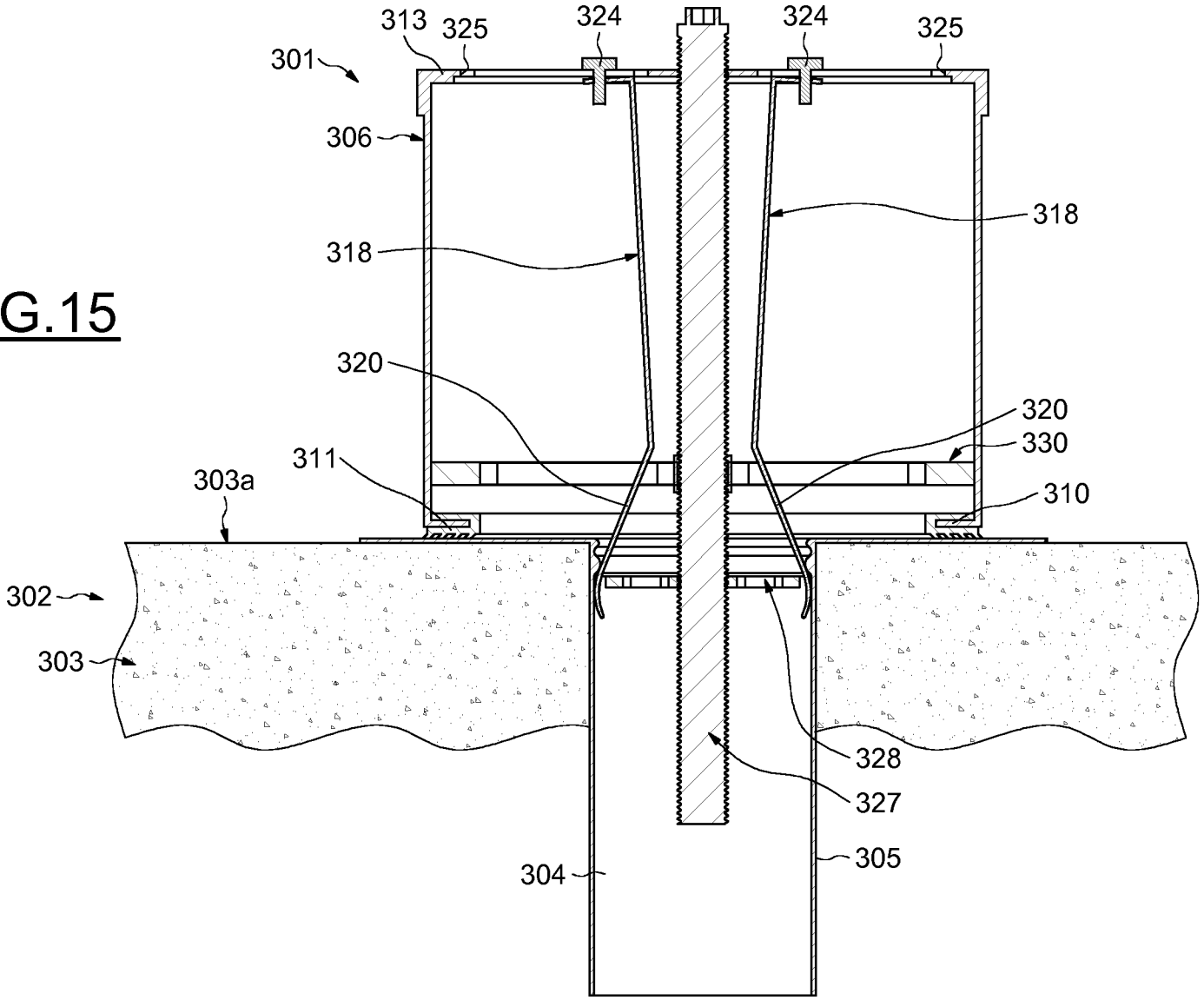
FIGS. 15 to 17 show a vertical section of the drainage device of FIG. 10 in various positions up to a locked position.

In this position, the screws 334 are slid radially inwards in the slots 325 in order to bring the bottom end parts 320 of the arms 318 into abutment against the peripheral wall of the discharge channel 304. This first intermediate assembly position is illustrated in FIG. 15.

Figure 16:
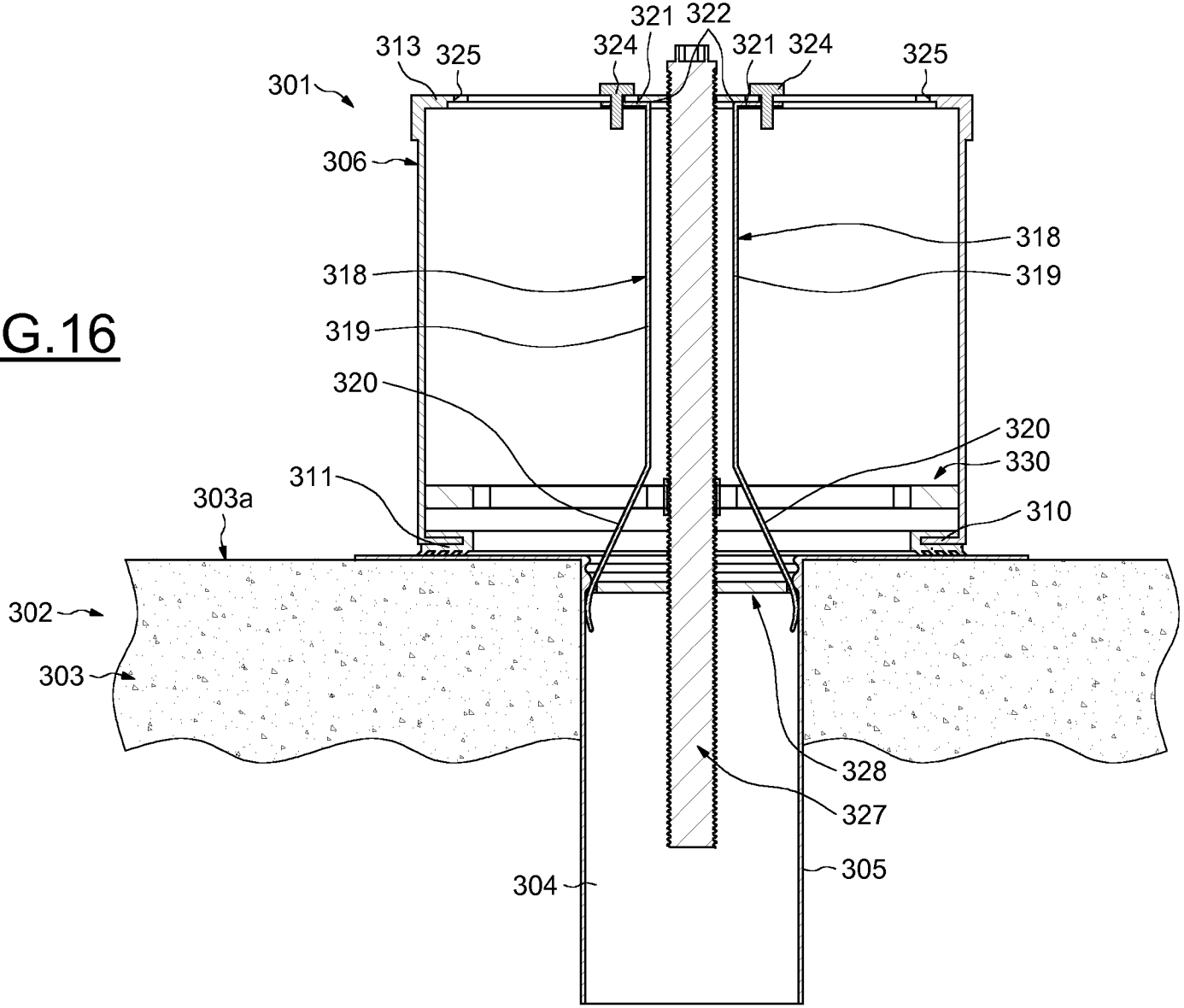

Next, the rod 327 is rotated in the clockwise direction by means of the top end thereof, which has the effect of axially raising the separation member 328 along the rod, as illustrated in FIG. 16. During the axial raising thereof, the separation member 328 slides on the bottom end parts 320 of the arms 318, which has the effect of radially constraining and gripping the arms 318 towards the outside against the peripheral wall of the discharge channel 304. This causes the elongate portions 319 of the arms of the rod 327 to move together. In this position, the fold 322 and the top actuation portion 321 of each arm is in abutment axially against the bottom face of the top radial wall 313 of the drainage head.

When the rod 327 is rotated in the clockwise direction, the axial rising of the separation member 318 on the same side as the shoulder 310 of the drainage head takes place here until the separation member 318 and the bottom end parts 320 of the arms 318 are locked by an annular projection 333 of the discharge pipe 305 that extends radially inwards from the discharge channel 304. This corresponds to a second intermediate assembly position.

The radial force exerted on the arms 318 by the separation member 328 ensures the holding of the drainage head 306 in abutment against the external surface 303*a* of the construction 302. When the arms 318 are clamped by the separation member 328, an elastic deformation of the bottom end parts 320 of the arms takes place against the discharge channel 304.

When the rod 327 is rotated in the clockwise direction, it also slides axially inside the drainage head by cooperation with the thread on the top radial wall 313 thereof. The compression plate 330 slides axially conjointly with the rod 327 while remaining axially at a distance from the seal 311. The arms 318 block the rotation of the plate during the sliding.

Figure 17:
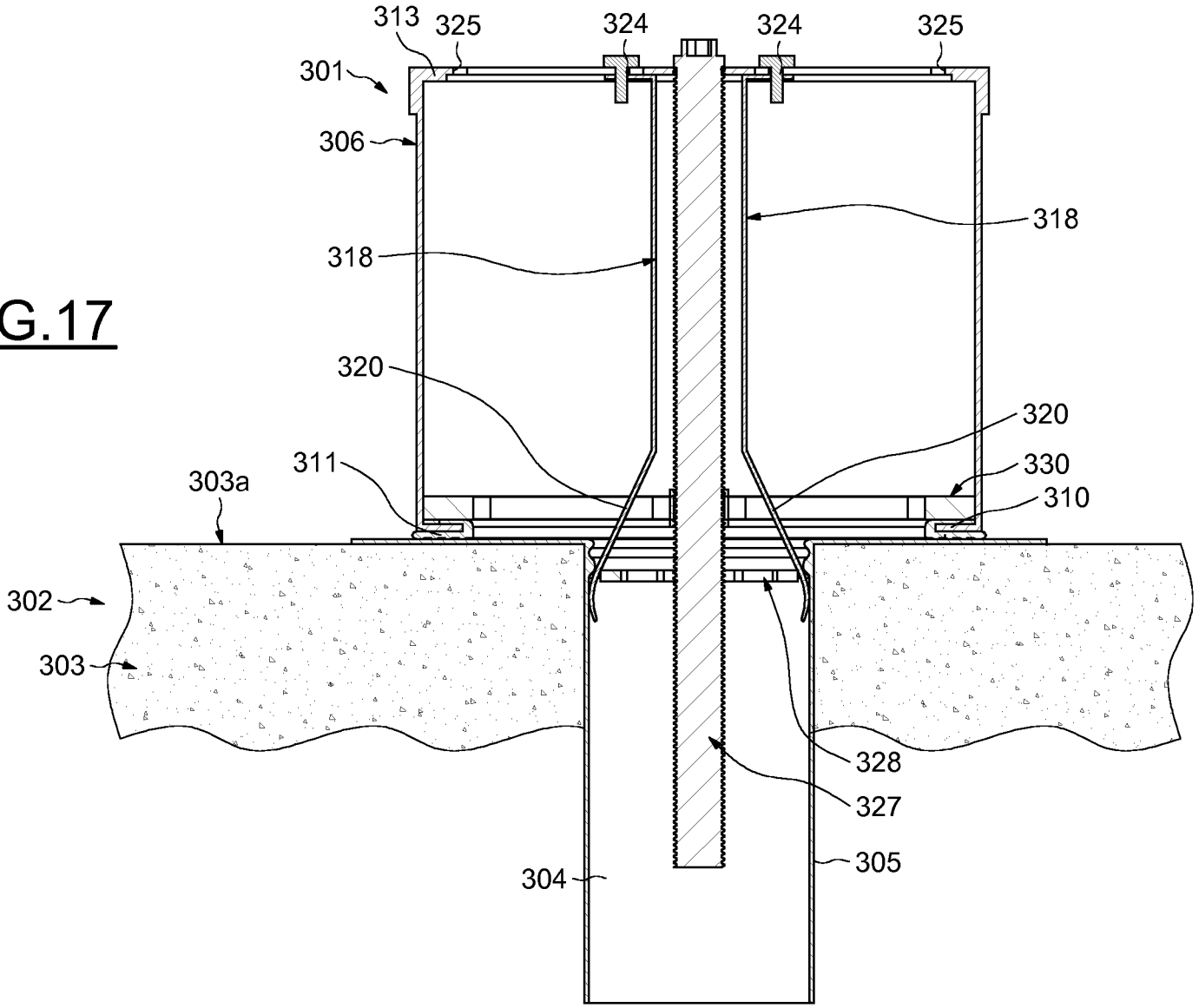

Next, from the blocked position of the separation member 318 illustrated in FIG. 16, when the rotation of the rod 327 in the clockwise direction is continued, the latter slides until the compression plate 330 comes axially into abutment against the seal 311, as illustrated in FIG. 17.

This ensures good axial pressing of the drainage head 306 against the external surface of the construction 302. During the pressing, an axial compression of the seal 311 is obtained between the drainage head 306 and the external surface of the construction 302.

In a similar manner to the other examples, the drainage device 301 may furthermore comprise a perforated cover (not shown) surrounding the drainage head 306 at a distance and mounted on the latter.

The invention claimed is:

1. A drainage device intended to be installed on a construction having an external surface and provided with a discharge channel, the drainage device comprising:

a drainage head comprising an external wall delimiting a recovery space and having a discharge passage around which the external wall has a support shoulder able to bear on the external surface of the construction, around the discharge channel, and at least one recovery passage; and a mounting element comprising a support or attachment element capable of being engaged inside the discharge channel, and a biasing element connecting the drainage head and the support or attachment element, the support or attachment element comprising a plurality of elastically deformable arms spaced from each other in the circumferential direction, the biasing element being able to act on the support or attachment element, so that the ends of the arms of the support or attachment element, abutting against the discharge channel, under the effect of the biasing element, are able to hold the support shoulder of the drainage head in abutment on the external surface of the construction, wherein the support or attachment element comprises a central portion provided with the arms at the periphery thereof, the arms being disposed around the central portion, wherein in the engaged position of the attachment element inside the discharge channel, the arms of the support or attachment element are curved towards the drainage head by the radial contact against the internal surface of the discharge channel in a position deformed counter to their elasticity, the ends of the arms bearing against the internal surface of the discharge channel at points spaced apart in the circumferential direction, and wherein the biasing element comprises a central rod intended to extend axially into the discharge channel in the engaged position of the attachment element inside the discharge channel and coupled to the central portion of the support or attachment element by screwing to the curvature of the arms during screwing in the engaged position.

2. The drainage device according to claim 1, wherein the biasing element comprises at least one connection member connecting the drainage head and the support or attachment element and capable of acting, under the effect of a drive member able to move the connection member, on the support or attachment element.

3. The drainage device according to claim 1, wherein the support or attachment element comprise a central portion provided with the arms at the periphery thereof, the biasing element cooperating with this central portion by screwing.

4. The drainage device according to claim 3, wherein the ends of the arms of the support or attachment element abutting against the peripheral wall of the discharge channel are offset axially with respect to the central portion of the support or attachment element on the same side as the drainage head in the engaged position of the element inside the discharge channel.

5. The drainage device according to claim 1, wherein the arms of the support or attachment element, in the idle position, define a larger periphery than the periphery of the discharge channel.

6. The drainage device according to claim 1, wherein the recovery passage of the drainage head comprises a calibrated bottom recovery passage and a top passage for recovery by overflow that is larger than the calibrated bottom passage.

7. The drainage device according to claim 1, comprising an annular seal able to be interposed axially between the drainage head and the construction.

8. The drainage device according to claim 7, wherein the annular seal is axially prestressed in the position of holding the support shoulder of the drainage head in abutment on the external surface of the construction through the action of the biasing element on the support or attachment element.

9. The drainage device according to claim 1, wherein the drainage head comprises an end pipe connected to the peripheral external wall and able to be engaged inside the discharge channel, the support or attachment element extending beyond the end edge of this end pipe.

* * * * *